US011377991B2

(12) United States Patent
Murakami et al.

(10) Patent No.: US 11,377,991 B2
(45) Date of Patent: Jul. 5, 2022

(54) MUFFLER DEVICE

(71) Applicant: HONDA MOTOR CO., LTD., Tokyo (JP)

(72) Inventors: Hiroko Murakami, Wako (JP); Tadafumi Hirose, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 177 days.

(21) Appl. No.: 16/757,587

(22) PCT Filed: Aug. 3, 2018

(86) PCT No.: PCT/JP2018/029214
§ 371 (c)(1),
(2) Date: Apr. 20, 2020

(87) PCT Pub. No.: WO2019/123708
PCT Pub. Date: Jun. 27, 2019

(65) Prior Publication Data

US 2021/0199034 A1 Jul. 1, 2021

(30) Foreign Application Priority Data

Dec. 19, 2017 (JP) ..... JP2017-243064

(51) Int. Cl.
*F01N 1/08* (2006.01)
*F01N 1/02* (2006.01)

(52) U.S. Cl.
CPC ..... *F01N 1/084* (2013.01); *F01N 1/089* (2013.01); *F01N 1/026* (2013.01);
(Continued)

(58) Field of Classification Search
CPC .. F01N 1/084; F01N 2230/04; F01N 2230/06; F01N 2330/06; F01N 2470/22; F01N 2590/06
See application file for complete search history.

(56) References Cited

U.S. PATENT DOCUMENTS 4,890,690 A * 1/1990 Fischer ..... F01N 13/18 181/240
2006/0131102 A1* 6/2006 Rauch ..... F01N 1/02 181/272

(Continued)

FOREIGN PATENT DOCUMENTS

CN 204175376 U 2/2015
DE 9314441 U1 * 1/1994 ..... F01N 3/2889

(Continued)

OTHER PUBLICATIONS

Machine translation of JP-2016160914-A, dated Dec. 9, 2021. (Year: 2021).*

(Continued)

*Primary Examiner* — Jonathan R Matthias
(74) *Attorney, Agent, or Firm* — Rankin, Hill & Clark LLP

(57) ABSTRACT

A lightweight and compact muffler device that can be installed in a limited space in an inside of a generator. A top cover and an undercover (end cover) provided on a top and a bottom of a vertically disposed casing are each formed in substantially trapezoidal shape. Thereby, an inner capacity of the casing can be secured to be large, as a result of which, a size of the muffler device can be made compact, and no extra component is required, so that reduction in manufacturing cost and reduction in weight can be achieved. Since the casing is disposed vertically, it is possible to install the casing even when an installation space is small in an inside of a housing of a generator, and it is possible to make the generator compact.

6 Claims, 5 Drawing Sheets

(52) U.S. Cl.
CPC ..... *F01N 2230/04* (2013.01); *F01N 2230/06* (2013.01); *F01N 2470/02* (2013.01); *F01N 2470/22* (2013.01); *F01N 2590/06* (2013.01)

(56) References Cited

U.S. PATENT DOCUMENTS

| | | | | |
|---|---|---|---|---|
| 2015/0114750 | A1* | 4/2015 | Yoshida | F01N 13/0097 181/228 |
| 2017/0087514 | A1 | 3/2017 | Daoud et al. | |

FOREIGN PATENT DOCUMENTS

| | | | | |
|---|---|---|---|---|
| EP | 0816648 | A1 | 1/1998 | |
| EP | 1541823 | A2 * | 6/2005 | F01N 1/04 |
| JP | 2005-155551 | | 6/2005 | |
| JP | 2006-207531 | | 8/2006 | |
| JP | 2015-034478 | | 2/2015 | |
| JP | 2016160914 | A * | 9/2016 | F01N 3/101 |
| JP | 2016-183632 | | 10/2016 | |
| WO | 2014/147916 | | 9/2014 | |

OTHER PUBLICATIONS

Machine translation of EP-0816648-B1, dated Dec. 9, 2021. (Year: 2021).*
Indian Office Action dated Sep. 16, 2021, 5 pages.
International Preliminary Report on Patentability dated Jul. 2, 2020, 8 pages.
Chinese Office Action dated Jun. 29, 2021, 7 pages.
International Search Report, dated Apr. 9, 2018, 4 pages.
Written Opinion of the International Searching Authority dated Sep. 4, 2018 filed in PCT/JP2018/029214, 4 pages.
European Search Report dated Feb. 8, 2021, 6 pages.

* cited by examiner

MUFFLER DEVICE

TECHNICAL FIELD

The present invention relates to a muffler device, and particularly relates to a muffler device that is applied to an engine of a portable generator.

BACKGROUND ART

There has been conventionally known a muffler device for silencing an engine.

As the muffler device like this, for example, there is conventionally disclosed a technology that includes outer plates, and a cylindrical outer shell that supports the respective outer plates, and reduces exhaust noise by reducing exhaust energy in a muffler (refer to Patent Literature 1, for example).

CITATION LIST

Patent Literature

[Patent Literature 1]
Japanese Patent Laid-Open No. 2005-155551

SUMMARY OF INVENTION

Technical Problem

The above described conventional technology is a technology concerning a muffler device of an engine for a vehicle. However, there is known a generator that drives an engine and generates power by the driving force, and the aforementioned conventional technology cannot be directly applied as the muffler device of the generator like this.

In particular, a portable generator needs to be equipped with a catalyst device to purify NOx, and in addition, the portable generator is required to be lightweight and compact.

An aspect of the present invention is made in the light of the aforementioned point, and has an object to provide a lightweight and compact muffler device that can be installed in a limited space in an inside of a generator, and can ensure a sufficient capacity.

Solution to Problem

In order to attain the above described object, an aspect of the present invention is a muffler device of a portable generator, including a casing disposed vertically, wherein end covers provided on a top and a bottom of the casing are each formed in a substantially trapezoidal shape.

According to an aspect of the present invention, an inner capacity of the casing can be secured to be larger as compared with a case where the end covers are each formed into a planar shape, and rigidity can also be enhanced. As a result, the size of the muffler device can be made compact, and no extra component is required, so that reduction in manufacturing cost and reduction in weight can be achieved. Further, since the casing is disposed vertically, it becomes possible to install the casing even when the installation space is small in the inside of the housing of the generator, and it becomes possible to make the generator compact.

In the above described configuration, the end covers are formed of a top cover provided at an upper portion of the casing, and an undercover provided at a lower portion of the casing, and an inclined surface is formed on a top surface of the top cover, and an exhaust pipe and a tail pipe are connected to the inclined surface of the top cover.

According to the present invention, it becomes possible to concentrate the connection portions to the exhaust pipe and the tail pipe on the upper portion of the casing, and maintainability can be improved.

The above described configuration includes a catalyst device in an inside of the casing, wherein the catalyst device is disposed in a vertical direction.

According to an aspect of the present invention, by disposing the catalyst device in the vertical direction, carbon in the inside of the catalyst device can be made difficult to accumulate.

In the above described configuration, a diffuser pipe is disposed between a connection portion of the top cover to the exhaust pipe, and a placement position of the catalyst device, in the inside of the casing.

According to an aspect of the present invention, the diffuser pipe is disposed between the connection portion to the exhaust pipe, and the placement position of the catalyst device, and therefore, a space in which the exhaust gas flowing into the casing exists before entering the catalyst device can be secured to be wide. As a result, the high-temperature exhaust gas flowing into the casing from the exhaust pipe is cooled before flowing into the catalyst device, and it becomes possible to prevent the catalyst device from being deteriorated by the high-temperature exhaust gas.

In the above described configuration, the diffuser pipe extends over a substantially entire region in an up-down direction of the casing, and an arrester is disposed in a connection portion of the diffuser pipe to the tail pipe.

According to an aspect of the present invention, the arrester is disposed in the inside of the connection pipe of the diffuser pipe, and therefore, reduction in size can be achieved while the silencing function is kept.

The specification claims the benefit of priority of Japanese Patent Application No. 2017-243064 filed on Dec. 19, 2017, the entire contents of which are hereby incorporated by reference.

Advantageous Effects of Invention

According to an aspect of the present invention, as compared with the case where the end covers are each formed in a planar shape, the inner capacity of the casing can be secured to be larger, and rigidity can also be enhanced. As a result, the size of the muffler device can be made compact, and no extra component is required, so that reduction in manufacturing cost and reduction in weight can be achieved. Further, since the casing is disposed vertically, it becomes possible to install the casing even when the installation space is small in the inside of the housing of the generator, and the generator can be made compact.

DESCRIPTION OF EMBODIMENT

Hereinafter, an embodiment of the present invention will be described with reference to the drawings.

Figure 1:
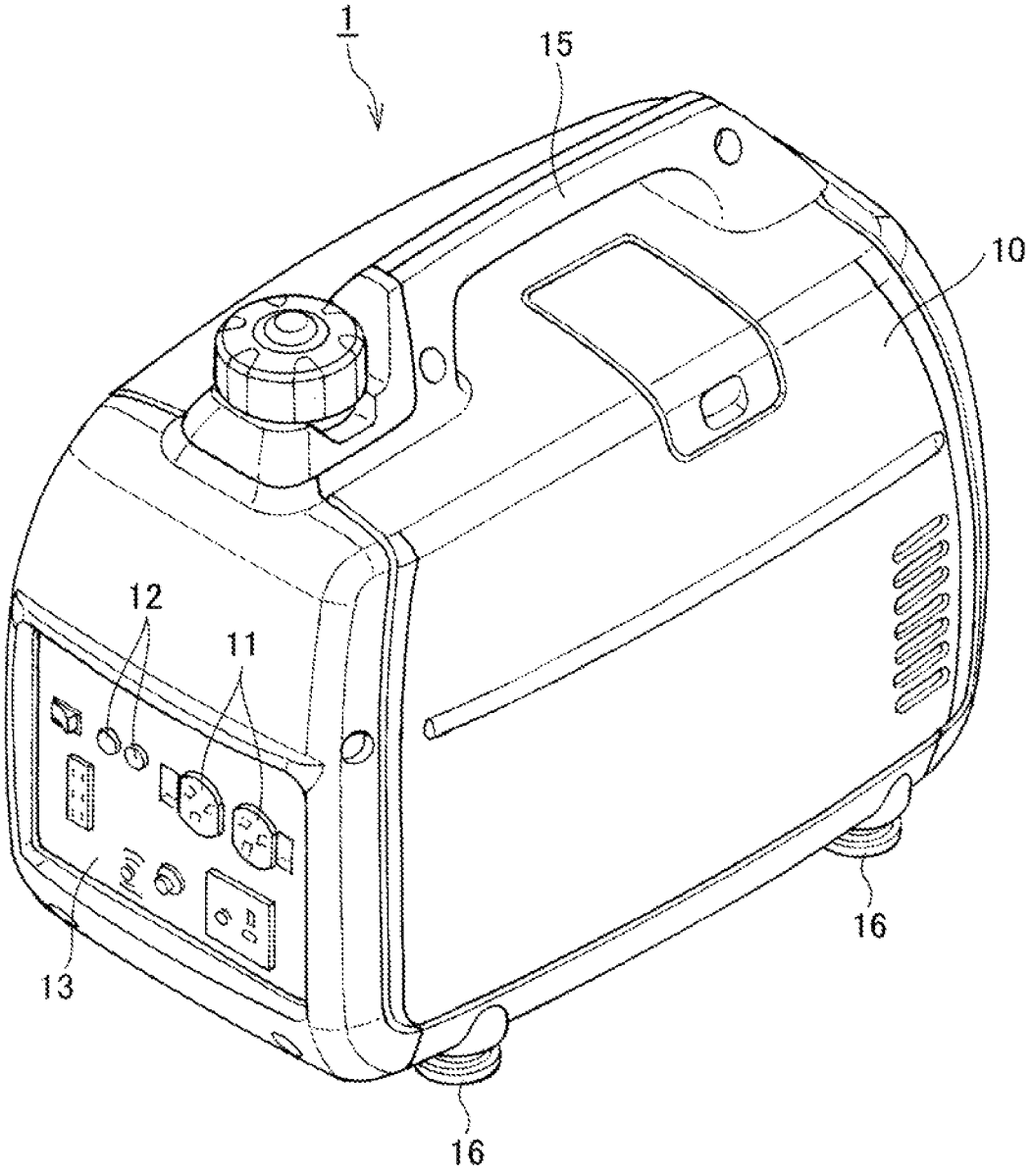
FIG. 1 is an external view illustrating an embodiment of a generator to which a muffler device of the present invention is applied.

FIG. 1 is a perspective view illustrating an external appearance of a portable generator to which a muffler device according to the present invention is applied.

As illustrated in FIG. 1, a generator 1 includes a housing 10 in a substantially rectangular parallelepiped shape, and an engine (not illustrated) and a muffler device 20 (refer to FIG. 2) are housed in a lower part inside of the housing 10. Power generation is enabled via an alternator by driving the engine.

Further, a control panel 13 in which power outlets 11, operation buttons 12 and the like are disposed is fitted to one side surface of the housing 10.

Further, a handle 15 is provided on a top surface of the housing 10, and a plurality of legs 16 that support the housing 10 are attached to an undersurface of the housing 10.

Next, the muffler device will be described.

Figure 2:
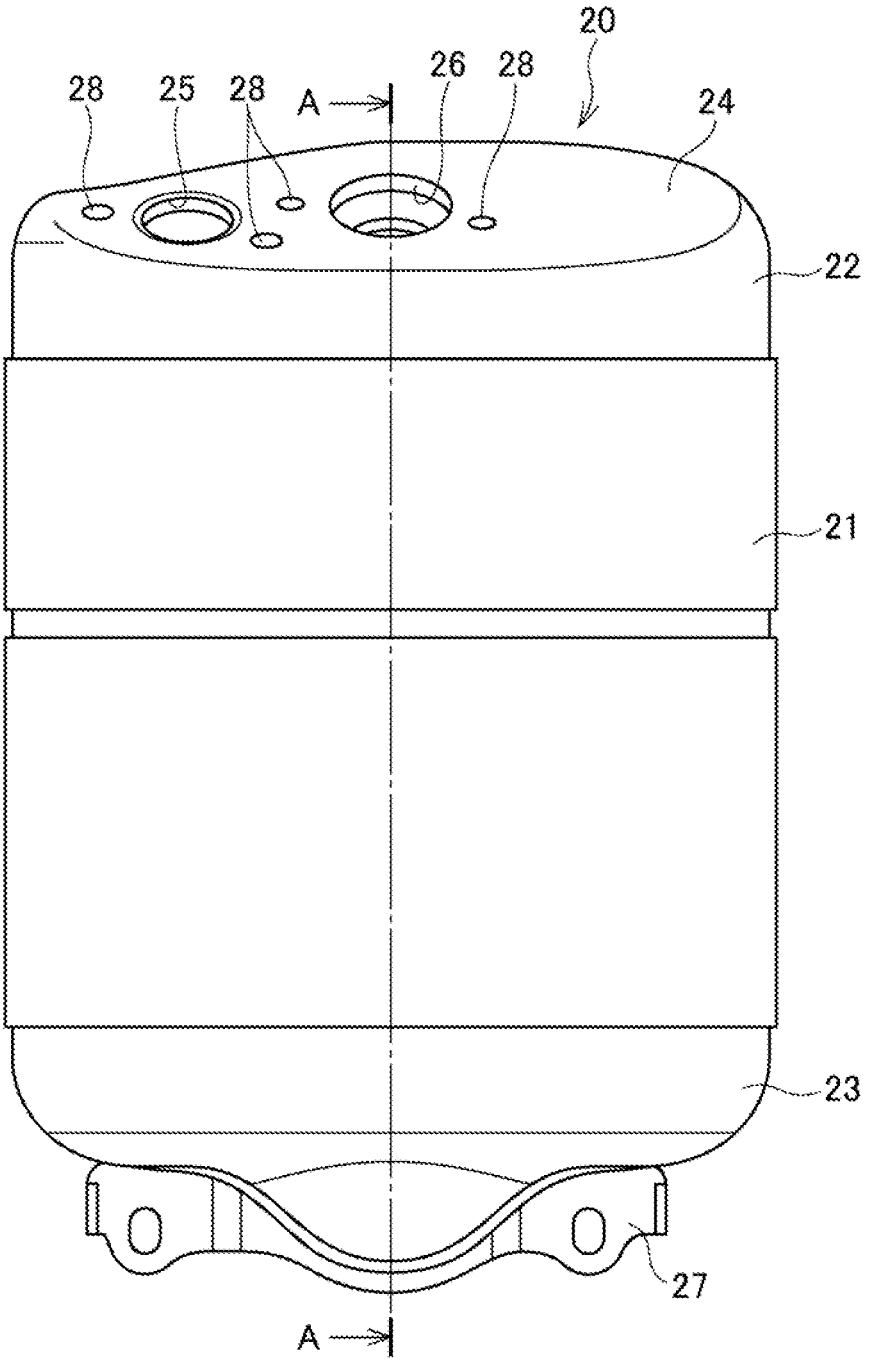
FIG. 2 is a front view of the muffler device of the present embodiment.
Figure 3:
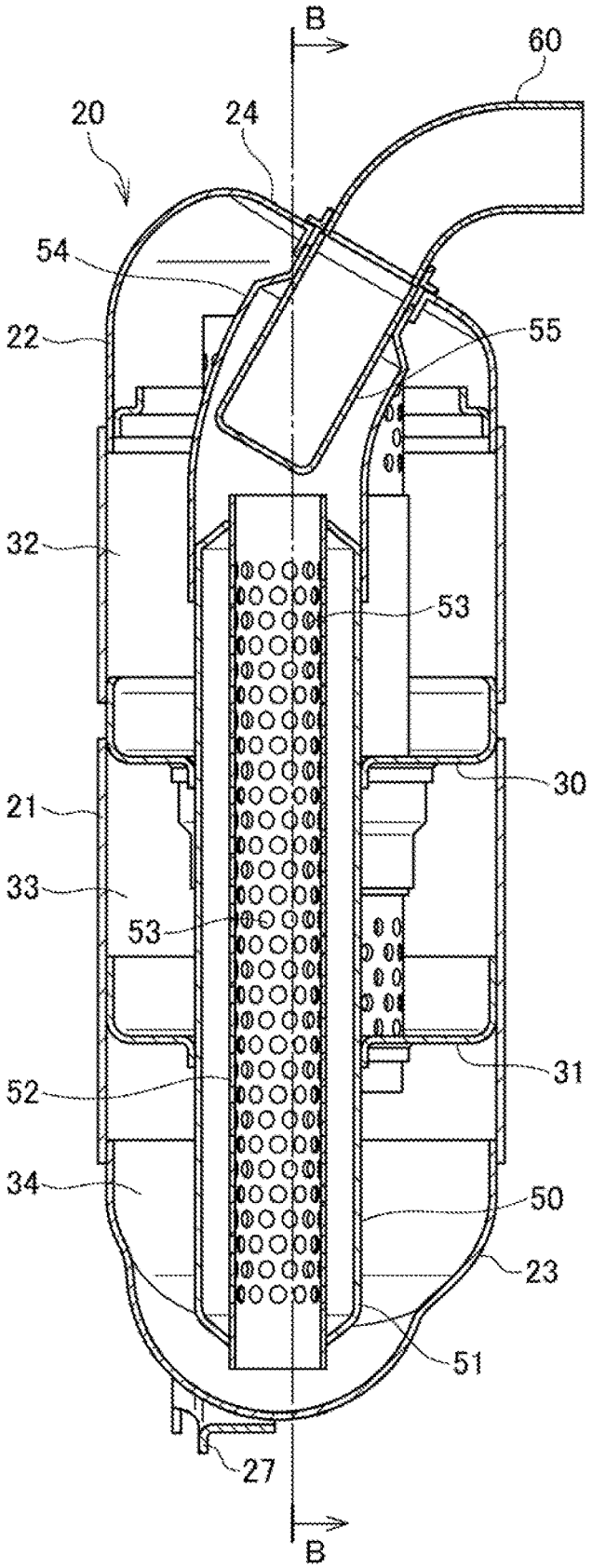
FIG. 3 is a sectional view in line A-A in FIG. 2.
Figure 4:
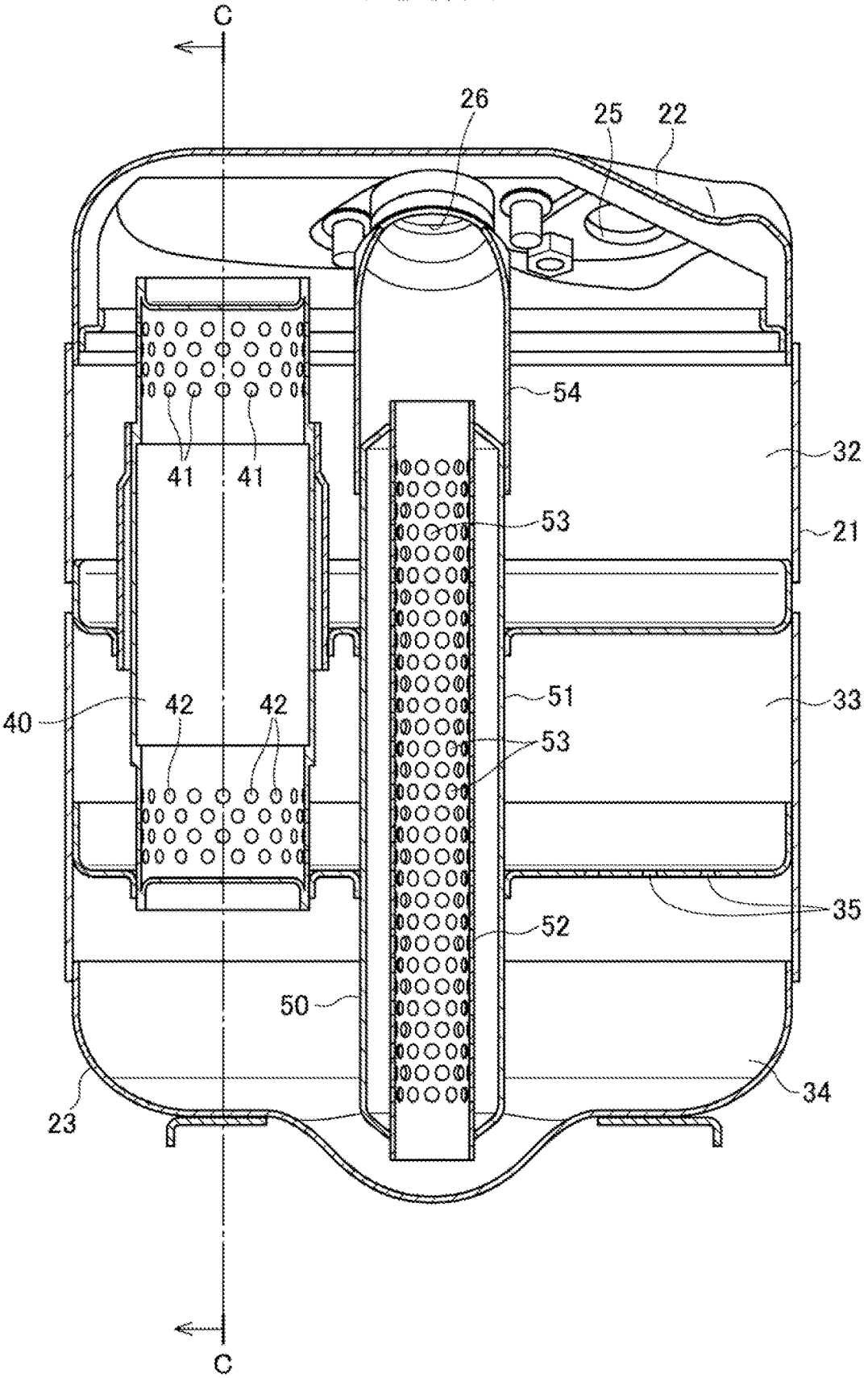
FIG. 4 is a sectional view in line B-B in FIG. 3.
Figure 5:
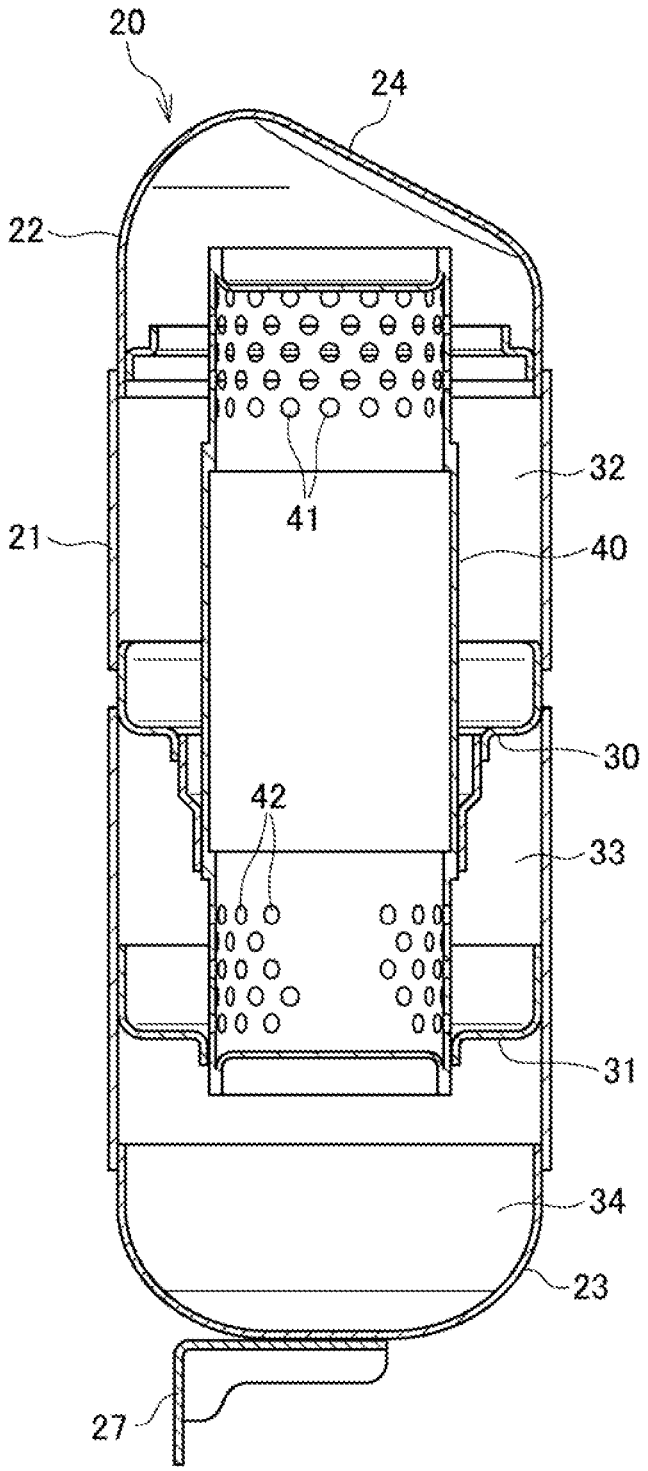
FIG. 5 is a sectional view in line C-C in FIG. 4.

FIG. 2 is a front view of the muffler device. FIG. 3 is a sectional view in line A-A in FIG. 2. FIG. 4 is a sectional view in line B-B in FIG. 3. FIG. 5 is a sectional view in line C-C in FIG. 4.

As illustrated in FIG. 2 to FIG. 5, the muffler device 20 includes a casing 21, and the casing 21 is formed into an elliptical shape in plan view and has a flat shape in a front-rear direction. The casing 21 is formed, for example, by doubly winding and molding a plate-shaped member. In the present embodiment, the casing 21 is installed vertically.

Further, a top cover 22 that forms an end cover is attached to an upper portion of the casing 21, and an undercover 23 forming an end cover is attached to a lower portion of the casing 21. In the top cover 22, a top surface includes an inclined surface 24 that inclines downward to a front. Further, the top cover 22 has a rear part formed in a curved surface shape, and is formed into a substantially trapezoidal shape in side view.

An exhaust hole 25 for connecting an exhaust pipe (not illustrated) is formed on one side of the inclined surface 24 of the casing 21, and a tail pipe hole 26 for connecting a tail pipe 60 is formed in a substantially center of the inclined surface 24, respectively.

In the present embodiment, by connecting the exhaust pipe to the inclined surface 24 of the casing 21, it is possible to apply cooling air for the engine to the exhaust pipe, and it is possible to reduce a temperature of exhaust gas of the engine, which flows in the exhaust pipe.

The undercover 23 has a shape in which corner portions in the front-rear direction are formed into curved surface shapes, and a central portion swells downward, and is formed into a substantially trapezoidal shape in side view as a whole. An attaching flange 27 is formed on an undersurface of the undercover 23 to protrude downward.

Further, screw holes 28 are formed respectively in a periphery of the exhaust hole 25 and in a periphery of the tail pipe hole 26.

A first partition wall 30 and a second partition wall 31 that are disposed with a predetermined space in an up-down direction are respectively provided in an inside of the casing 21. The inside of the casing 21 is partitioned into an upper first chamber 32, an intermediate second chamber 33, and a lower third chamber 34 by the first partition wall 30 and the second partition wall 31. The first chamber 32 communicates with the exhaust hole 25. The second partition wall 31 is provided with a communication hole 35 that allows the second chamber 33 and the third chamber 34 to communicate with each other.

In the inside of the casing 21, a catalyst device 40 that extends in a vertical direction to penetrate through the first partition wall 30 and the second partition wall 31 is provided. Pores 41 by punching that open to the first chamber 32 are formed in an upper portion of the catalyst device 40. Pores 42 by punching that open to the second chamber 33 are formed in a lower portion of the catalyst device 40.

By disposing the catalyst device 40 in the vertical direction in this way, it is possible to make it difficult for carbon inside of the catalyst device 40 to accumulate.

In the inside of the casing 21, a diffuser pipe 50 that extends over a substantially entire region in the up-down direction by penetrating through the first partition wall 30 and the second partition wall 31 is provided. The diffuser pipe 50 is formed of an outer tube 51 and an inner tube 52, and a large number of pores 53 formed by punching are formed in the inner tube 52. The outer tube 51 and the inner tube 52 are integrally formed by welding or the like on upper sides and lower sides thereof.

A connection pipe 54 that is connected to the tail pipe hole 26 is connected to an upper end portion of the outer tube 51, and an arrester 55 is disposed inside of the connection pipe 54.

In the present embodiment, the diffuser pipe 50 is disposed between the exhaust hole 25 that is a connection portion of the exhaust pipe, and a placement position of the catalyst device 40. Accordingly, high-temperature exhaust gas that flows into the first chamber 32 from the exhaust pipe is cooled before flowing into the catalyst device 40, and it becomes possible to prevent the catalyst device 40 from being deteriorated by the high-temperature exhaust gas.

Further, since the arrester 55 is disposed in an inside of the connection pipe 54 of the diffuser pipe 50, it becomes possible to achieve compactification while keeping a silencing function.

The muffler device 20 of the present embodiment is attached to the generator 1, for example, by fixing the attaching flange 27 to a crankcase of the engine by screws, and fastening the exhaust pipe to the exhaust hole 25 by screws via the screw holes 28.

It is possible to detach the muffler device 20 easily by only detaching the respective screws. As a result, maintenance of the muffler device 20 can be performed easily.

Next, an operation of the muffler device 20 configured in this way will be described.

Exhaust gas generated from the engine firstly flows into the first chamber 32 of the casing 21 via the exhaust hole 25 via the exhaust pipe. At this time, the exhaust gas can be caused to flow into the casing 21 in a state where a temperature of the exhaust gas is reduced by effectively using cooling air of the engine, by connecting the exhaust pipe to the inclined surface 24 of the top cover 22.

The exhaust gas flowing into the first chamber 32 enters the catalyst device 40 via the pores 41, and after the exhaust gas passes through the catalyst device 40, the exhaust gas flows into the second chamber 33 via the pores 42.

Since the diffuser pipe 50 is disposed between the connection portion of the exhaust pipe, and the placement position of the catalyst device 40, a space in which the exhaust gas flowing into the first chamber 32 exists before entering the catalyst device 40 can be secured to be wide at this time, whereby the high-temperature exhaust gas flowing into the first chamber 32 from the exhaust pipe is cooled before flowing into the catalyst device 40. As a result, it becomes possible to prevent the catalyst device 40 from being deteriorated by the high-temperature exhaust gas.

Further, since the exhaust gas is caused to flow into the catalyst device 40 via the pores 41 of the catalyst device 40, it is possible to reduce a flow velocity of the exhaust gas, and it is possible to reduce occurrence of airflow noise.

The exhaust gas flowing in the second chamber 33 from the catalyst device 40 flows into the third chamber 34 via communication holes 35, and flows into a lower end of the diffuser pipe 50 from the third chamber 34. The exhaust gas flowing into the diffuser pipe 50 flows out to inside of the outer tube 51 via the pores 53 from the inner tube 52, and flows to inside of the inner tube 52 via the pores 53 again. By repeating this, airflow noise and vibration sound can be reduced.

The exhaust gas flowing in the diffuser pipe 50 is released to an outside from the tail pipe 60 via the arrester 55.

As described above, in the present embodiment, the casing 21 that is disposed vertically is included, and the top cover 22 and the undercover 23 (end cover) that are provided on a top and a bottom of the casing 21 are each formed into a substantially trapezoidal shape.

Thereby, as compared with a case where the top cover 22 and the undercover 23 are each formed into a planar shape, an inner capacity of the casing 21 can be secured to be large, and rigidity can be also enhanced. As a result, the size of the muffler device 20 can be reduced, and no extra parts are required, so that reduction in manufacturing cost and reduction in weight can be achieved. Further, since the casing 21 is disposed vertically, it is possible to install the casing 21 even when an installation space is small inside of the housing of the generator 1, and it is possible to reduce the size of the generator 1.

Further, in the present embodiment, the end cover is formed of the top cover 22 provided on the upper portion of the casing 21, and the undercover 23 provided on the lower portion of the casing 21, the inclined surface 24 is formed on the top surface of the top cover 22, and the exhaust pipe and the tail pipe 60 are connected to the inclined surface 24 of the top cover 22.

Thereby, it is possible to concentrate the connection portions of the exhaust pipe and the tail pipe 60 on the upper portion of the casing 21, and it is possible to improve maintainability.

Further, in the present embodiment, the catalyst device 40 is included in the inside of the casing 21, and the catalyst device 40 is disposed in the vertical direction.

Accordingly, it is possible to make it difficult for carbon inside of the catalyst device 40 to accumulate, by disposing the catalyst device 40 in the vertical direction.

Further, in the present embodiment, the diffuser pipe 50 is disposed between the connection portion of the exhaust pipe on the top cover 22, and the placement position of the catalyst device 40, in the inside of the casing 21.

Accordingly, since the diffuser pipe 50 is disposed between the connection portion of the exhaust pipe, and the placement position of the catalyst device 40, the space where the exhaust gas flowing in the casing 21 exits before entering the catalyst device 40 can be secured to be wide. As a result, the high-temperature exhaust gas flowing into the casing 21 from the exhaust pipe is cooled before flowing into the catalyst device 40, and it becomes possible to prevent the catalyst device 40 from being deteriorated by the high-temperature exhaust gas.

Further, in the present embodiment, the diffuser pipe 50 extends over the substantially entire region in the up-down direction of the casing 21, and the arrester 55 is disposed in the connection portion of the diffuser pipe 50 to the tail pipe 60.

Accordingly, since the arrester 55 is disposed in the inside of the connection pipe 54 of the diffuser pipe 50, it is possible to reduce the size while keeping the silencing function.

Note that the present invention is not limited to what is described in the above described embodiment, but various modifications and changes can be made within the range without departing from the gist of the present invention.

REFERENCE SIGNS LIST

1 Generator
10 Housing
20 Muffler device
21 Casing
22 Top cover
23 Undercover
24 Inclined surface
25 Exhaust hole
26 Tail pipe hole
30 First partition wall
31 Second partition wall
32 First chamber
33 Second chamber
34 Third chamber
35 Communication hole
40 Catalyst device
50 Diffuser pipe
51 Outer tube
52 Inner tube
54 Communication pipe
55 Arrester
60 Tail pipe

The invention claimed is:

1. A muffler device of a portable generator, comprising:

a casing disposed vertically, wherein end covers provided on a top and a bottom of the casing are each formed in a substantially trapezoidal shape, the end covers are formed of a top cover provided at an upper portion of the casing, and an undercover provided at a lower portion of the casing, an inclined surface is formed on a top surface of the top cover, and an exhaust pipe and a tail pipe are connected to the inclined surface of the top cover, and the muffler device comprising a catalyst device in an inside of the casing, wherein a diffuser pipe is disposed between a connection portion of the top cover to the exhaust pipe and a placement position of the catalyst device, in the inside of the casing, an exhaust hole connecting the exhaust pipe is formed in the inclined surface, the catalyst device includes an inflow hole through which the exhaust gas flows into the catalyst device, the muffler device comprises a path in which the exhaust gas flows from the exhaust hole to the inflow hole of the catalyst device, in the path, the diffuser pipe is disposed between the exhaust hole and the inflow hole of the catalyst device, a first partition wall and a second partition wall that are disposed with a predetermined space in an up-down direction are provided in an inside of the casing, the inside of the casing is partitioned into a first chamber at an upper side, a second chamber at an intermediate part, and a third chamber at a lower side by the first partition wall and the second partition wall, the first chamber communicates with the exhaust hole, the second partition wall is provided with a communication hole that allows the second chamber and the third chamber to communicate with each other, the catalyst device penetrates through the first partition wall and protrudes upward from the first partition wall, the inflow hole of the catalyst device opens to the first chamber, the catalyst device further includes an outflow hole which opens to the second chamber and through which the exhaust gas flows out of the catalyst device.

2. The muffler device according to claim 1, wherein the catalyst device is disposed such that a longitudinal direction of the catalyst device is in a vertical direction.

3. The muffler device according to claim 2, wherein the diffuser pipe extends over a substantially entire region in an up-down direction of the casing, and an arrester is disposed in a connection portion of the diffuser pipe to the tail pipe.

4. The muffler device according to claim 1, wherein the diffuser pipe extends over a substantially entire region in an up-down direction of the casing, and an arrester is disposed in a connection portion of the diffuser pipe to the tail pipe.

5. The muffler device according to claim 4, wherein the diffuser pipe includes a connection pipe connected to the tail pipe hole, and the arrester is disposed inside of the connection pipe.

6. The muffler device according to claim 1, wherein the diffuser pipe extends to penetrate through the first partition wall and the second partition wall and protrudes downward from the second partition wall, and the diffuser pipe includes a lower end which is located inside the third chamber and through which the exhaust gas flows into an inside of the diffuser pipe.

* * * * *